US009842479B1

(12) United States Patent
Black

(10) Patent No.: US 9,842,479 B1
(45) Date of Patent: Dec. 12, 2017

(54) SYSTEMS INCLUDING A SMART DEVICE FOR RECEIVING A PRERECORDED MESSAGE AND TRANSMITTING THE PRERECORDED MESSAGE TO A DETECTOR

(71) Applicant: Dathan O. Black, Huntsville, AL (US)

(72) Inventor: Dathan O. Black, Huntsville, AL (US)

(73) Assignee: Dathan O. Black, Huntsville, AL (US)

( * ) Notice: Subject to any disclaimer, the term of this patent is extended or adjusted under 35 U.S.C. 154(b) by 0 days.

(21) Appl. No.: 15/178,774

(22) Filed: Jun. 10, 2016

(51) Int. Cl.
*G08B 21/00* (2006.01)
*G08B 17/103* (2006.01)

(52) U.S. Cl.
CPC ..... *G08B 17/103* (2013.01)

(58) Field of Classification Search
CPC ..... G08B 17/103; G08B 17/107; G08B 17/10
USPC ..... 340/628
See application file for complete search history.

(56) References Cited

U.S. PATENT DOCUMENTS 5,349,338 A * 9/1994 Routman ..... G08B 7/06 340/584
2006/0226970 A1* 10/2006 Saga ..... G08B 27/001 340/506
2011/0263228 A1* 10/2011 Selby ..... H04M 1/642 455/413
2014/0062693 A1* 3/2014 Watts ..... G08B 27/006 340/539.11
2015/0065078 A1* 3/2015 Mejia ..... G08B 17/00 455/404.1
2015/0077737 A1* 3/2015 Belinsky ..... G01N 21/53 356/51
2015/0110277 A1* 4/2015 Pidgeon ..... H04R 3/00 381/56

* cited by examiner

*Primary Examiner* — Mark Rushing

(74) *Attorney, Agent, or Firm* — Lanier Ford Shaver & Payne PC

(57) ABSTRACT

A warning system of the present disclosure has at least two detectors for detecting conditions within a structure that are communicatively coupled via a wireless area network (WAN), and each detector is configured to activate an alert and to transmit data indicative of a detected condition to a smart device. In addition, the warning system has a processor configured to receive the data indicative of the detected condition and automatically initiate control logic resident on the smart device. Further, the processor is configured to initiate an alert in response that indicates the presence of the detected condition in the structure, which is conveyed to a user of the smart device.

21 Claims, 6 Drawing Sheets

SYSTEMS INCLUDING A SMART DEVICE FOR RECEIVING A PRERECORDED MESSAGE AND TRANSMITTING THE PRERECORDED MESSAGE TO A DETECTOR

BACKGROUND

One or more adverse condition detectors is typically installed in a structure, e.g., a residence or an office building. The detectors can be configured, based upon hardware in the detector, to detect one or more types of adverse conditions. For example, a detector may be configured to detect smoke, heat, fire, carbon monoxide, or carbon dioxide.

When a detector detects the adverse condition for which it is configured to detect, the detector typically gives warning to people within the structure. In this regard, the detector may sound a loud audible alarm that can be heard throughout the structure, which conveys to the people to leave the structure.

BRIEF DESCRIPTION OF THE DRAWINGS

The present system is described with reference to the accompanying drawings. In the drawings, like reference numbers indicate identical or functionally similar elements. The elements of the drawings are not necessarily to scale, emphasis instead being placed upon clearly illustrating the principles of the invention.

DETAILED DESCRIPTION

The present disclosure describes smart warning systems and methods. In particular, a smart warning system in accordance with an embodiment of the present disclosure comprises one or more detector devices that are configured to detect adverse conditions within a structure, e.g., a house, an office building, or the like. In one embodiment, the detector devices are smoke detectors. Other types of detectors may be used in other embodiments. For example, the detector devices may be configured to detect a carbon dioxide ($CO_2$) leak. Notably, the detector device of the present disclosure may be configured to detect any number of adverse conditions. As an example, the detector device may be configured to detect smoke and $CO_2$.

Further, the exemplary detectors of the present disclosure each comprise wireless technology. In this regard, each of the detectors is configured to communicate with each of the other detectors over a local area network (LAN). Additionally, at least one detector is configured to communicate over a cellular network. Thus, information may be readily transmitted by each detector to a cellular device, e.g., a smart phone. Note that a smart phone is merely an example, and the cellular device may include any type of device that is configured to communicate with other cellular devices over the cellular network. For example, the smart device may be a tablet or a laptop.

Figure 1A:
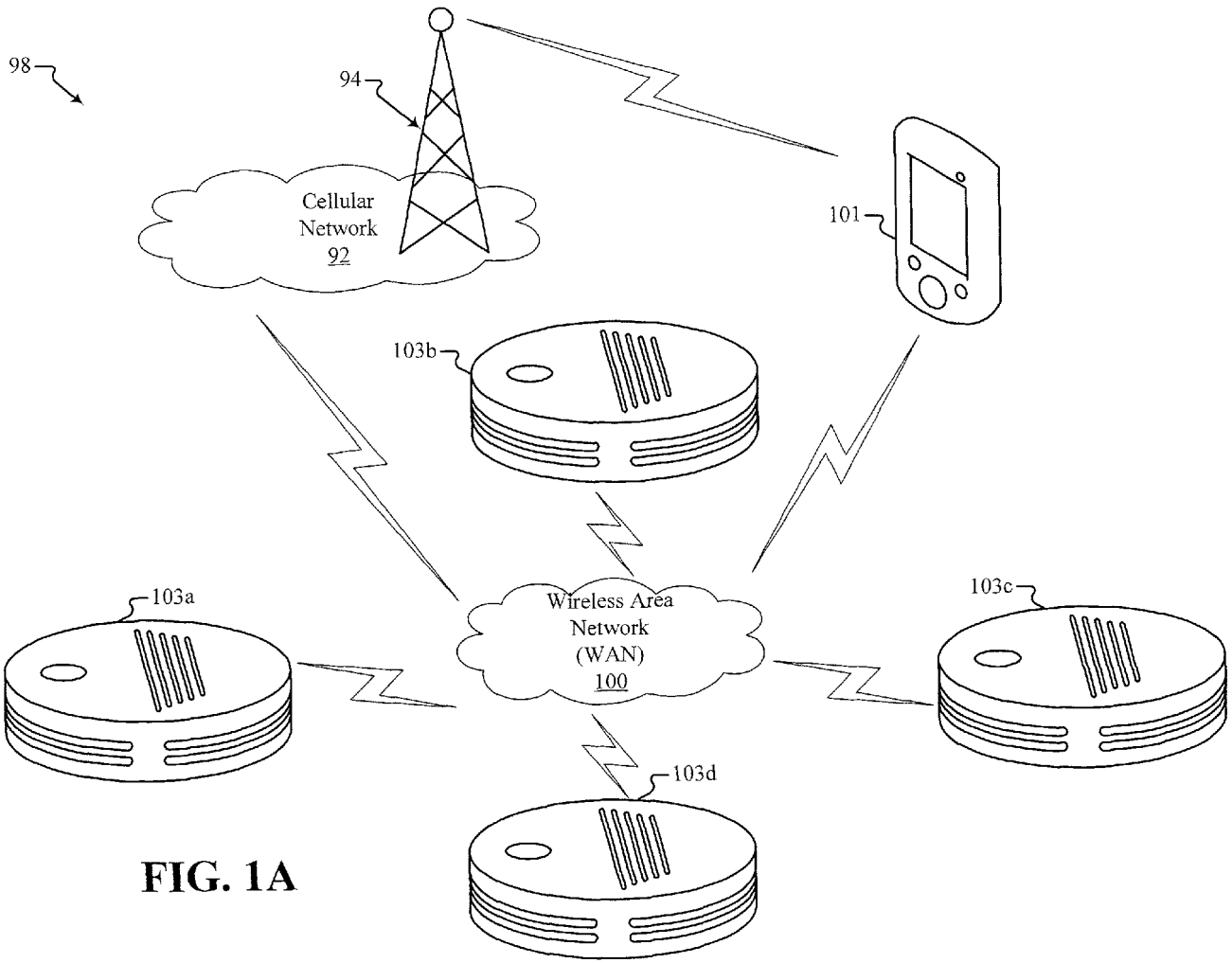
FIG. 1A is a diagram of a wireless network of an exemplary smart warning system in accordance with an embodiment of the present disclosure.

FIG. 1A depicts a smart warning system 98 in accordance with an embodiment of the present disclosure. The smart warning system 98 comprises four detectors 103*a*-103*d*, a cellular device 101, a wireless area network (WAN) 100, and a cellular network 92.

The cellular network 92 comprises at least one cell tower 94 and other devices and components that work together to provide communication between devices and/or networks. In the present disclosure, the cell tower 94 is communicatively coupled to the smart device 101 and the detectors 103*a*-103*d* via the WAN 100. Thus, the cellular network provides communication via the smart device 101 and the detectors 103*a*-103*d*.

As noted hereinabove, the smart device 101 is configured to communicate with at least one cell tower 94, which is part of the cellular network 92. Additionally, the smart device is configured to communicate with at least one of the detector devices 103*a*-103*d* over the WAN 100. Note that the smart device 101 may be any type of device known in the art or future-developed that comprises a transceiver (not shown). For example, the smart device 101 may be a cellular phone, a tablet, or a laptop computer. The transceiver transmits messages from the smart device 101 through the cell tower 94, which in turn (based upon data in the message) transmits the messages to the detectors 103*a*-103*d* via the WAN 100. Also, the transceiver receives messages from the detectors 103*a*-103*d* through the cell tower 94.

Further note that the WAN 100 may be any type of network known in the art that is configured to facilitate communication between the detectors 103*a*-103*d* and the smart device 101, between each of the detectors 103*a*-103*d*, and between the detectors 103*a*-103*d* and the cellular network 92. Note that in one embodiment, the WAN 100 is a "mesh network," which means that each of the detectors 103*a*-103*d* is considered a "node," and each node relays data through the WAN 100 thereby cooperating in the distribution of messages in the WAN 100.

Each detector 103*a*-103*d* is configured to detect adverse conditions within the structure (not shown) in which they are installed. For example, the detectors 103*a*-103*d* may detect the presence of smoke. In another embodiment, the detectors may detect the presence of $CO_2$.

Figure 1B:
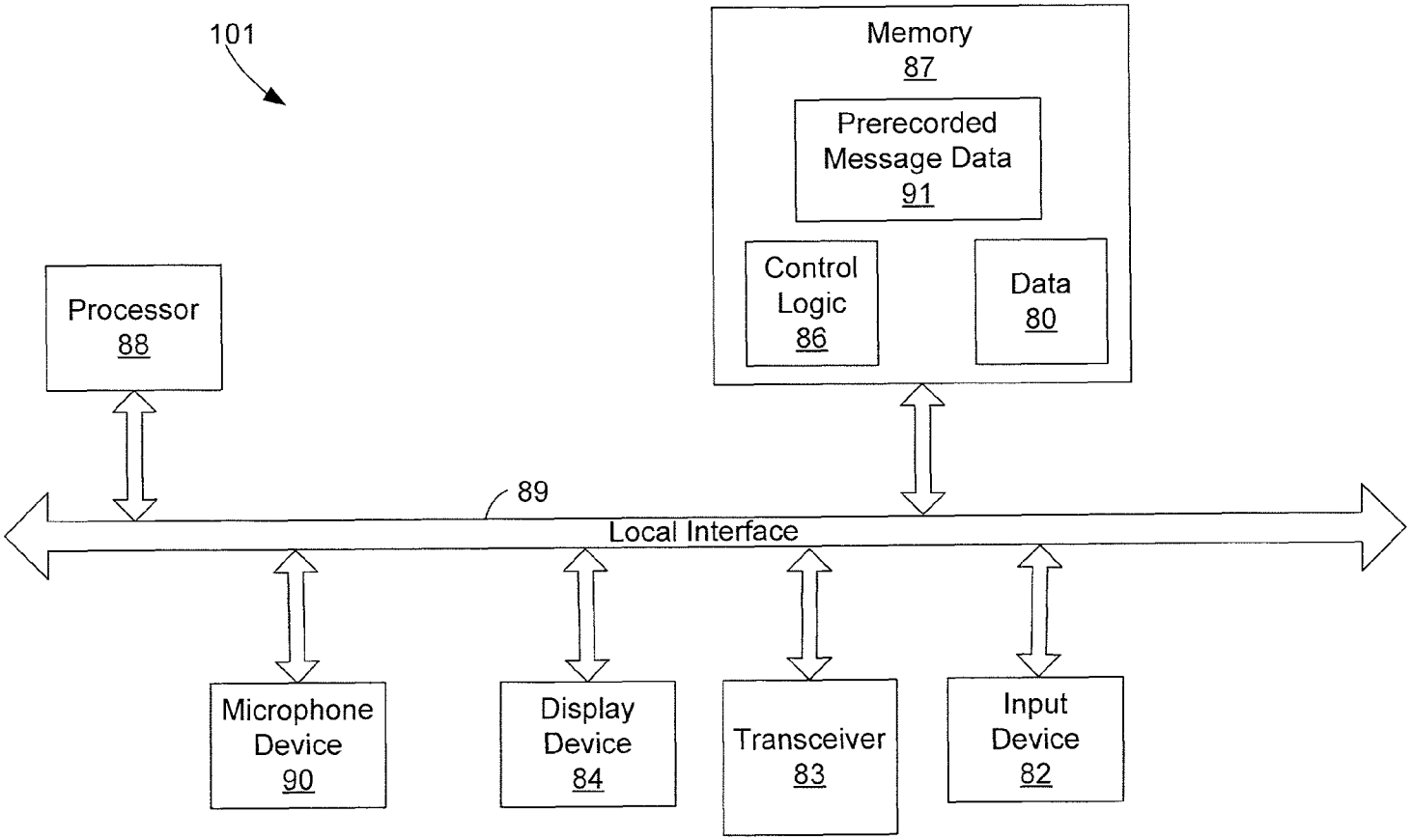
FIG. 1B is a block diagram of an exemplary smart device as depicted in FIG. 1.

FIG. 1B depicts an exemplary smart device 101 of the present disclosure. The exemplary smart device 101 comprises a processor 88, display device 84, input device 82, microphone device 90, and transceiver 83. Each of these components communicates over local interface 89, which can include one or more buses.

Smart device 101 further comprises control logic 86. Control logic 86 can be software, hardware, or a combination thereof. In the exemplary smart device 101 shown in FIG. 1B, control logic 86 is shown as software stored in memory 87. Memory 87 may be of any type of memory known in the art, including, but not limited to random access memory (RAM), read-only memory (ROM), flash memory, and the like.

As noted hereinabove, control logic 86 are shown in FIG. 1B as software stored in memory 87. When stored in memory 87, control logic 86 can be stored and transported on any computer-readable medium for use by or in connection with an instruction execution system, apparatus, or device, such as a computer-based system, processor-containing system, or other system that can fetch the instructions from the instruction execution system, apparatus, or device and execute the instructions.

In the context of the present disclosure, a "computer-readable medium" can be any means that can contain, store, communicate, propagate, or transport the program for use by or in connection with the instruction execution system, apparatus, or device. The computer readable medium can be, for example but not limited to, an electronic, magnetic, optical, electromagnetic, infrared, or semiconductor system, apparatus, device, or propagation medium Processor 88 may be a digital processor or other type of circuitry configured to run the control logic 86 by processing and executing the instructions of the control logic 86. The processor 88 communicates to and drives the other elements within the smart device 101 via the local interface 89.

In addition, the transceiver 83 is an electronic component that is configured to transmit and receive messages from a network. The transceiver 83 may be any type of device known in the art from communicating via networks to other electronic components on the networks.

The display device 84 is a device for visually communicating information to a user (not shown). The display device 84 may be, for example, a backlit liquid crystal display (LCD) screen (not shown), which is touch-sensitive for operation with a stylus (not shown). Other types of display devices may be used in other embodiments of the present disclosure.

The input device 82 enables the user to enter data into the smart device 101. In one embodiment, the input device 82 is a keyboard, and the user uses the keyboard to type data into the smart device 101, which can be stored as data 80. In addition, the display device 84 may be a touch screen (not shown), and the smart device 101 may comprise a stylus (not shown) that the user can used to enter data via the touch screen (not shown).

One exemplary input device, the microphone device 90, may be any type of sound capture device known in the art or future-developed. In one embodiment, the microphone device 90 captures analog data indicative of a user's voice and translates the analog data into digital data. In the embodiment, the user (not shown) speaks into the microphone device 90 a message that the user desires to be played if adverse conditions are detected by one of the detectors 103*a-d*. The control logic 86 stores the digital data indicative of the message as prerecorded message data 91. Further, the control logic 86, either automatically, periodically, or upon request by the user via the input device 82, transmits the prerecorded message data 91 to one or all of the detectors 103*a*-103*d*.

Figure 2:
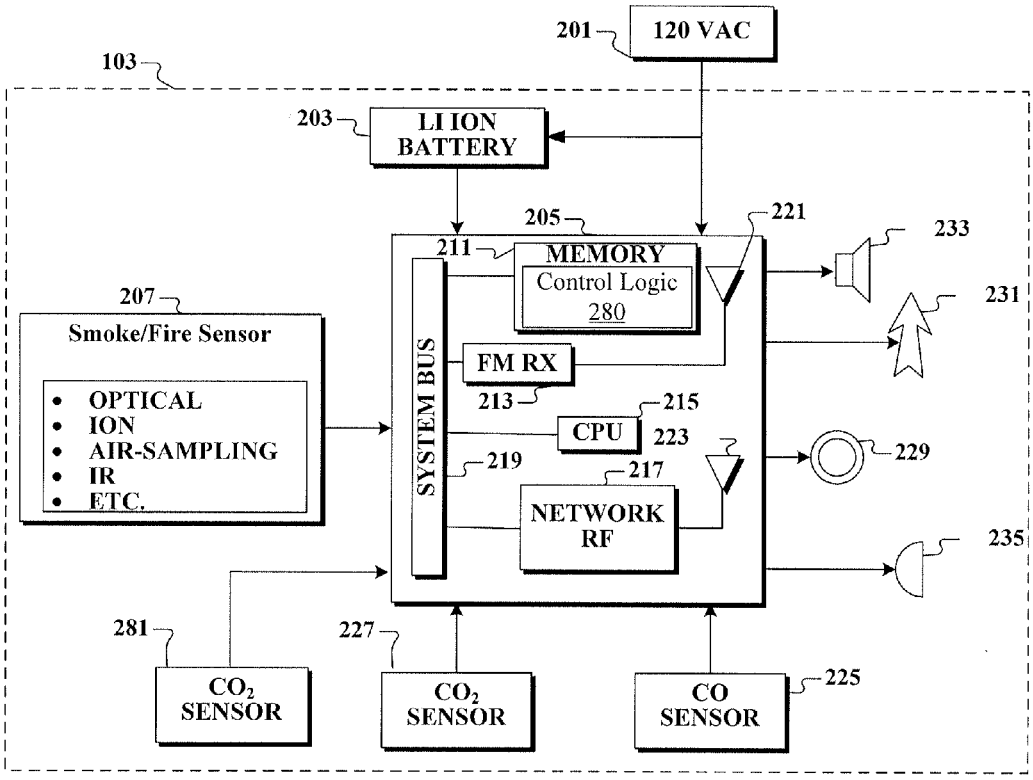
FIG. 2 is a block diagram of an exemplary detector of the smart warning system of FIG. 1A.

FIG. 2 is a block diagram of an exemplary detector 103*a* of the present disclosure. Note that only 103*a* is described, however, the other detectors 103*b*-103*d* are configured identically.

As illustrated in FIG. 2, the detector 103*a* comprises one or more sensors configured to detect the presence of an adverse condition. The exemplary sensors in 103*a* include, but are not limited to, smoke/fire sensor 207, CO2 sensor 227, and CO sensor 225. Thus, the detector 103*a* is configured to detect smoke, fire, CO and $CO_2$.

In one embodiment, the smoke/fire sensor 207 may comprise an optical sensor that is configured to detect any number of conditions, e.g., smoke, fire, presence of an individual, etc. The smoke/fire sensor 207 may comprise a potentiometric sensor (or ion sensor) that detects the presence of analytes in the air. The smoke/fire sensory 207 may perform air-sampling to detect analytes in the air. Also, the smoke/fire sensor may comprise an infrared sensor that may be used to detect flames. The afore-described sensors are merely examples of the types of sensors that may be used in the detector 103*a*. Any sensor technology hereafter developed suitable for sensing the presence of smoke or fire may be used in the detector 103*a* of the present disclosure.

The detector 103*a* may be powered by standard residential electricity supply (e.g., 120 VAC) 201. Additionally, the detector may comprise a rechargeable battery 203 in the event residential power fails. As depicted in the diagram, the battery 203 may be charged with the residential electricity supply 201.

Detector 103*a* also preferably comprises one or more visual and aural warning displays, for example, a speaker 233 through which the above-referenced voice messages are played, a buzzer 229, as well as a light display 231. In one embodiment, the light display 231 may comprise an arrow shape that points the way to egress from the building. Optionally, detector may comprise a microphone 235. So configured, any detector 103*a*-103*d* may be used as a two-way communication system, either detector-to-phone, or detector-to-detector, via the WAN 100 (FIG. 1A).

Detector 103*a*-103*d* preferably further comprises a computer-based processor system 205 which may be configured with a central processing unit (CPU) 215 connected to a communication bus 219, and a computer-readable memory 211, such as, without limitation, flash memory, read-only memory (ROM), or random access memory (RAM), and can also include a secondary memory. The memory 211 may comprises control logic 280.

Control logic 280 comprises instructions, which are executed by the processor system 205 to operate in a specific and predefined manner, as described below. Control logic 280 may be implemented as one or more modules. The modules may be configured to reside in the processor memory. The modules include, but are not limited to, software or hardware components that perform certain tasks. Thus, a module may include, by way of example, components, such as, software components, processes, functions, subroutines, procedures, attributes, class components, task components, object-oriented software components, segments of program code, drivers, firmware, micro-code, circuitry, data, and the like. Control logic 280 may be installed in the memory 211 using a computer interface coupled to the communication bus 219 which may be any suitable input/output device. The computer interface may also be configured to allow a user to vary the control logic 280, either according to pre-configured variations or customizable variations.

As will be appreciated by those skilled in the relevant art, the processor system 205 may be achieved with a specialized apparatus to perform the steps described herein by way of one or more dedicated processor systems 205 with hard-wired logic or programs stored in nonvolatile memory, such as, by way of example, read-only memory (ROM), for example, components such as ASICs, FPGAs, PCBs, microcontrollers, or multi-chip modules (MCMs).

The processor system 205 further comprises a mesh network radio frequency transceiver 217 coupled to an antenna 223. A mesh network is a network topology in which each node in the network relays data, cooperating to distribute such data. Wireless mesh networks may use any suitable wireless communications protocol, e.g., cellular, IEEE 802.11, IEEE 802.15, or the like. In one embodiment of the processor system 205, the network transceiver 217 is compatible with a wireless protocol particularly useful in local area network (LAN) applications, such as Wi-Fi® (802.11), or in personal area network (PAN) applications, such as BlueTooth® (802.15), Z-wave, wireless internet, etc. In addition, the processor system 205 may optionally comprise a frequency modulated (FM) radio receiver coupled to a compatible antenna. This allows a detector 103*a* to receive warnings through FM radio from EAS, providing a means to receive notifications in the event a smart phone 101 is not within the WAN 100.

Note that in one embodiment, the prerecorded message data 91 (FIG. 1B) is received by one or more detectors 103*a*-103*b*, and the control logic 280 stores the prerecorded message data 91 in memory 211. In the event that one of the sensors 207, 281, 227, or 225 detects an adverse condition, the control logic 208 may play the prerecorded message on the speaker 233 so that it is audible for those in the structure or building in which the detectors 103*a*-103*d* are installed.

Figure 3A:
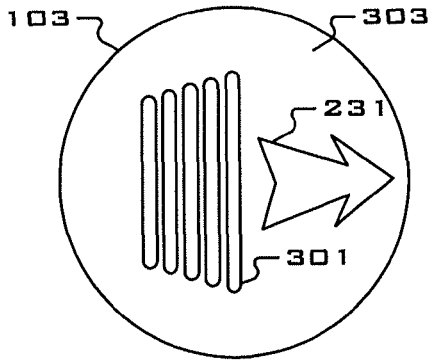
FIG. 3A is an exemplary housing for the detector depicted in FIG. 2.
Figure 3B:
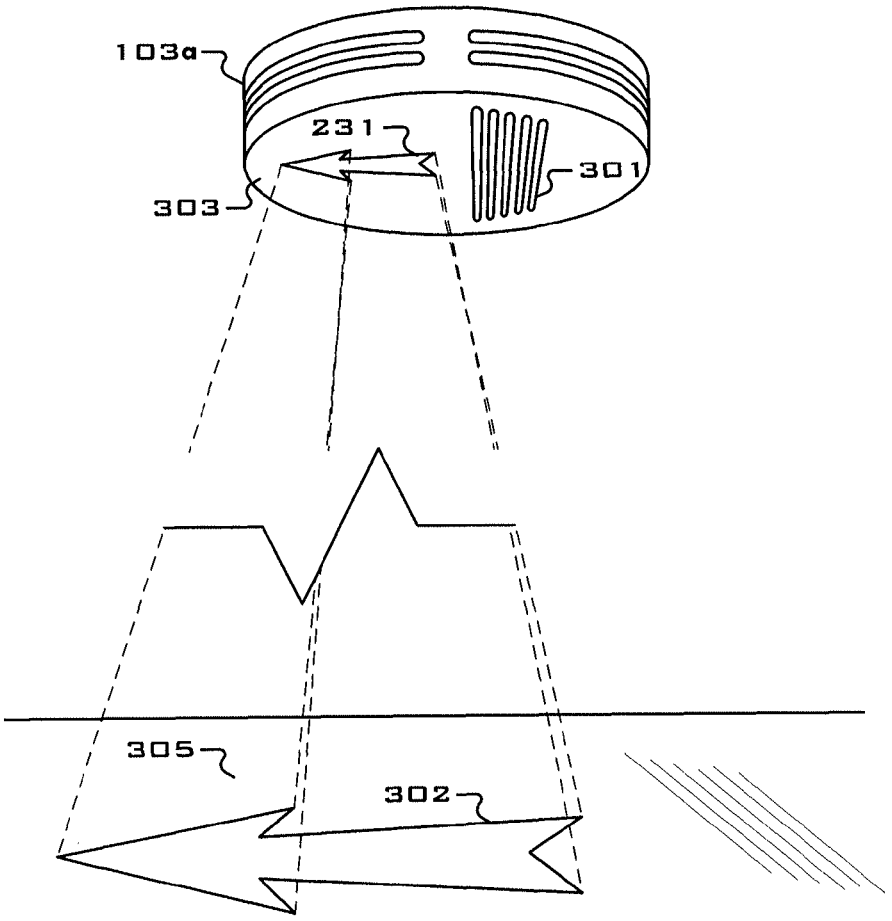
FIG. 3B is the detector of FIG. 3A showing a projection of an arrow shape to indicate direction for egress.

FIG. 3A illustrates an exemplary housing 303 for a detector 103*a*-103*d*, a grid 301 of openings for aural messages to be emitted, and an arrow-shaped light display 231. In FIG. 3B, the arrow-shaped light 231 may include a projection lens that allows light from the arrow-shaped light 231 to be projected as an arrow shape image 302 on a floor 305 pointing in the direction toward safe egress.

Figure 4:
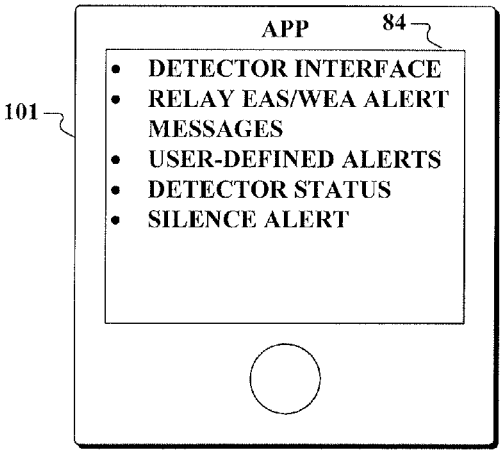
FIG. 4 depicts an exemplary smart device user interface of the smart warning system depicted in FIG. 1A.

FIG. 4 is a diagram of a user interface that is displayed by control logic 86 (FIG. 1B) to a display device 84. simply illustrates a smart phone, known in the art or hereafter developed, that is configured with control logic 86 (FIG. 1B) and that facilitates a user to control the system 98 (FIG. 1A).

In this regard, the control logic 86 displays a list of options to a user (not shown). In the exemplary user interface the user has the following options: "DETECTOR INTERFACE," "RELAY EAS/WEA ALERT MESSAGES," "USER-DEFINED ALERTS," "DETECTOR STATUS," and "SILENCE ALERT."

When the detector interface selection is selected by the user, the control logic 86 displays options for testing the detectors 103*a*-103*d*. In this regard, the control logic 86 is configured to transmit data indicative of a status query to at least one of the detectors 103*a*-103*d*. In response, each of the detectors self-tests for operational errors, e.g., a dead battery or inoperative connection through the WAN 100 to one or more other detectors 103*a*-103*d*.

When the relay eas/wea alert messages selection is selected by the user, the control logic 86 displays one or more options for forwarding alerts to the detectors 103*a*-103*d*. For example, there may be a tornado warning, and upon selection by the user, the control logic 86 transmits data indicative of the warning to the detectors 103*a*-103*d*. Upon receipt, the detectors 103*a*-103*d* are configured to initiate aural or visual alerts to alert occupants of the structure.

When the user-defined alerts selection is selected by the user, the control logic 86 provides a graphical user interface (GUI) that enables the user to define an alert that the control logic 86 transmits to the detectors 103*a*-103*d*. Upon definition, the user may elect to transmit data indicative of the user-defined alert to the detectors 103*a*-103*d*.

When the silence alert selection is selected by the user, this indicates that the alert message previously sent to the detectors 103*a*-103*d* isn't or is no longer valid. In response, the detectors 103*a*-103*d* silence some or all the aural or visual alerts that were previously initiated.

Figure 5A:
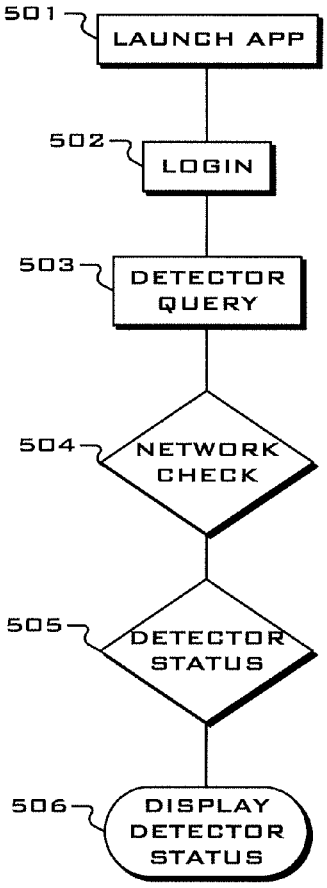
FIG. 5A is flowchart depicting exemplary architecture and functionality of a status check process of the smart device depicted in FIG. 4.

FIG. 5A is a flowchart depicting exemplary functionality and architecture of the control logic 86 (FIG. 1B) of the smart device 101. In step 501, the control logic 86 is launched by the smart device 101, and the control logic 86 displays a home graphical user interface (not shown) that may include displaying the options hereinabove outlined. Note that in one embodiment, the control logic 86 may automatically launch in order to provide alerts to the user of the status of the warning system 98. In another embodiment, the user may click on an icon (not shown) to affirmatively launch the control logic 86.

Upon launching the control logic 86 in step 501, the control logic 86 may request user login credentials in step 502. Note that in one embodiment, the control logic 86 may be launched selection by a user (not shown) of an icon displayed on the smart device 101 (FIG. 1). However, in other embodiments, the control logic 86 may be launched in other ways. In response to the request for user login credentials, the user enters the appropriate information via the input device 82 (FIG. 1B).

Once activated, the control logic 86 automatically issues a system check query in step 503 to the detector 103*a*-103*d* (FIG. 1A) via the WAN 100 (FIG. 1A) or the cellular network 92 (FIG. 1A). Note that the system check query may be issued by the control logic 86 in the form of a message or data packet that is transmitted to one or more detectors 103*a*-103*d*.

One or more of the detectors 103*a*-103*d* receive the status check query. In step 504, the one or more detectors 103*a*-103*d* respond either via the WAN 100 or the cellular network 92 by providing an indication of the status of the network in step 504. Additionally, in step 505 the one or more detectors transmit data indicative of the status of the detector 103*a*-103*d* in step 505. In step 506, the control logic 86 displays data indicative of the status of the WAN 100 and of each detector 103*a*-103 to the display device 84 (FIG. 1B).

Figure 5B:
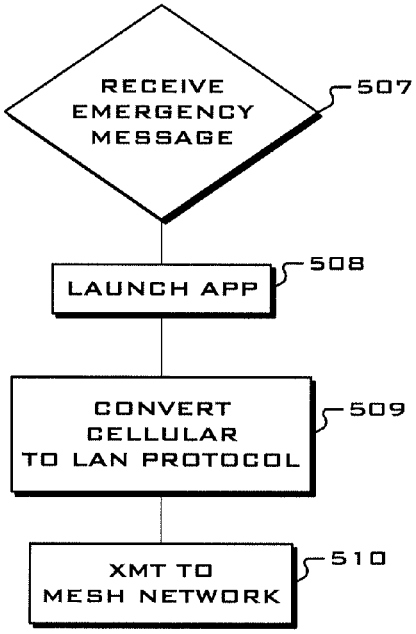
FIG. 5B is a flowchart depicting exemplary architecture and functionality of an emergency process of the smart device depicted in FIG. 4.

FIG. 5B is a flowchart depicting architecture and functionality of the control logic 86 when data indicative of an emergency ("emergency message") is received by the smart device 101 in step 807. Note that the emergency message may contain data indicative of the particular detector that is not operating appropriately or indicative of the network 100.

When an emergency message is received in step 507 through the WAN 100 and the cellular network 92 by the smart device 101, the control logic 86 is configured to launch automatically in step 508. The message is converted to from cellular network protocol to WAN protocol in step 509 then transmitted to the WAN 100 at step 509.

Figure 6A:
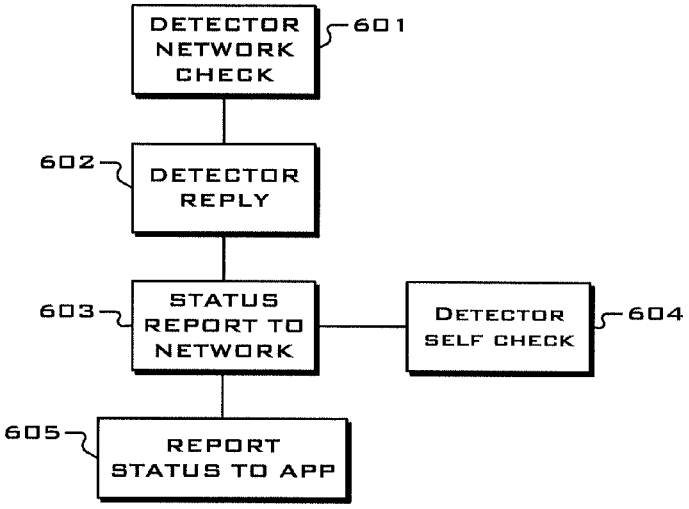
FIG. 6A is a flowchart depicting exemplary architecture and functionality of a status check process of the smart warning system depicted in FIG. 1A.
Figure 6B:
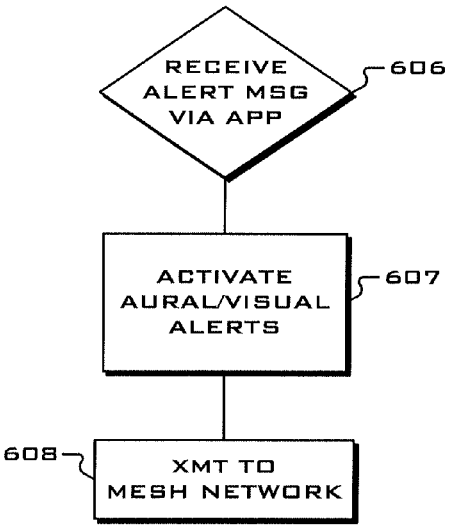
FIG. 6B is a flowchart depicting exemplary architecture and functionality of an alert message receipt process of the smart warning system depicted in FIG. 1A.
Figure 6C:
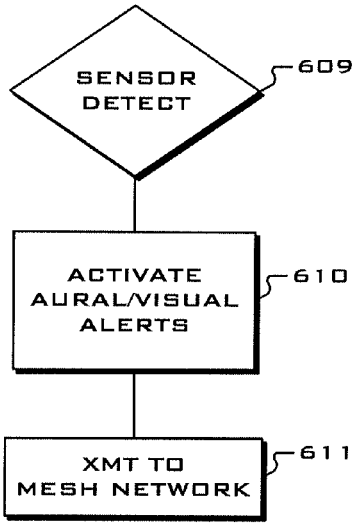
FIG. 6C is a flowchart depicting exemplary architecture and functionality of an alert activation process of the smart warning system depicted in FIG. 1A.

FIGS. 6A through 6C provide exemplary architecture and functionality of control logic 280 (FIG. 2) by the CPU 215 (FIG. 2) resident on the detectors 103*a*-103*d*. Periodically, any one detectors 103*a*-103*d* may initiate a network check in step 601 querying the other detectors 103*a*-103*d*. In response, the detectors 103*a*-103*d* answer the query 602 through the WAN 100. The control logic 280 transmits data indicative of the network health of other detectors 103*a*-103*b* in step 603. Additionally, the control logic 280 transmits the data indicative of a report status to the smart device 101.

Note that if a detector 103*a*-103*d* does not respond, the smart device 101 may flag the detector 103*a*-103*d* as inoperative. In one embodiment, each detector 103*a*-103*d* periodically executes a self-check in step 604 and automatically reports its status to the network at step 603. In this embodiment, the detectors 103*a*-103*d* transmits the data to the smart device 101 at step 605.

In the event an alert message is received by a detector 103*a*-103*d* via the smart device 101 in step 606, the detectors 103*a*-103*d* aurally and/or visually alert residents of the structure in step 607. Further, the data indicative of the alert message is transmitted to the other detectors 103*a*-103*d* in the WAN 100 in step 608. Similarly, if any detector 103*a*-103*d* detects fire, smoke, CO or CO2 in step 609, the detectors 103*a*-103*d* aurally and/or visually alert residents in the structure at step 610. Further, data indicative of the alert is transmitted to the WAN 100 in step 611. It should be noted that data indicative of the alert can also be transmitted to the smart device 101 via the WAN 100 and the cellular network 92.

What is claimed is:

1. A warning system, comprising:

at least two detectors for detecting conditions within a structure that are communicatively coupled to a wireless area network (WAN), wherein each detector is configured to activate an alert and to transmit data indicative of a detected condition to a smart device via the WAN;

first processor configured to receive the data indicative of the detected condition and automatically initiate control logic resident on the smart device, the processor is further configured to initiate an alert in response that indicates the presence of the detected condition in the structure, which is conveyed to a user of the smart device, wherein the smart device comprises a sound capture device for capturing data indicative of a prerecorded message and the smart device is configured to transmit data indicative of the prerecorded message to at least one of the detectors, and wherein the detectors are configured to play the prerecorded message upon detection of a particular condition within the structure.

2. The warning system of claim 1, wherein each detector is configured to activate an aural alert in response to the detected condition.

3. The warning system of claim 1, wherein each detector is configured to activate a visual alert in response to the detected condition.

4. The warning system of claim 3, wherein the visual alert comprises a light in the shape of an arrow that points in a direction of an egress from the structure, and the light is configured to reflect the shape of the arrow onto a floor in the structure.

5. The warning system of claim 1, wherein each of the two detectors is configured to bi-directionally communicate with the other detector.

6. The warning system of claim 5, wherein the processor is configured to transmit data indicative of a status query to a least one of the two detectors.

7. The warning system of claim 6, wherein the detector that receives the data indicative of the status query transmits the data indicative of the status query to the other detector.

8. The warning system of claim 7, wherein in response to the data indicative of the status query, each of the detectors performs a self-test to determine if the detectors are operational.

9. The warning system of claim 8, wherein at least on detector is configured to transmit data indicative of results of the self-test to the smart device.

10. The warning system of claim 8, wherein the processor is further configured to receive the data indicative of the results of the self-test and display data indicative of the results to the user.

11. The warning system of claim 1, wherein the processor is further configured to receive data from the user defining a user-defined alert.

12. The warning system of claim 11, wherein the processor is further configured to transmit data indicative of the user-defined alert to the detectors.

13. The warning system of claim 1, wherein the processor is further configured to transmit data to the detectors indicative of an alert silence, and in response, each of the detectors silence the activated alert.

14. The warning system of claim 1, wherein each detector comprises a carbon dioxide (CO2) sensor for detecting the conditions in the structure, and in response to detection, each detector is configured to initiate an alert and transmit data indicative of the alert to the smart device.

15. The warning system of claim 1, wherein each detector comprises a carbon monoxide (CO) sensor for detecting the conditions in the structure, and in response to detection, each detector is configured to initiate an alert and transmit data indicative of the alert to the smart device.

16. The warning system of claim 1, wherein each detector comprises an infrared sensor for detecting the conditions in the structure, and in response to detection, each detector is configured to initiate an alert and transmit data indicative of the alert to the smart device.

17. The warning system of claim 1, wherein each detector comprises an ion sensor for detecting the conditions in the structure, and in response to detection, each detector is configured to initiate an alert and transmit data indicative of the alert to the smart device.

18. The warning system of claim 1, wherein each detector comprises an optical sensor for detecting the conditions in the structure, and in response to detection, each detector is configured to initiate an alert and transmit data indicative of the alert to the smart device.

19. The warning system of claim 1, wherein each detector comprises an air-sampling sensor for detecting the conditions in the structure, and in response to detection, each detector is configured to initiate an alert and transmit data indicative of the alert to the smart device.

20. The warning system of claim 1, wherein at least one of the detectors comprises a microphone for capturing data indicative of a prerecorded message.

21. The warning system of claim 20, wherein the at least one detector is configured to play the prerecorded message upon detection of a particular condition within the structure.

* * * * *